US008006329B2

(12) United States Patent
Oh

(10) Patent No.: US 8,006,329 B2
(45) Date of Patent: Aug. 30, 2011

(54) MATTRESS-SUPPORTING BASE

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 0 days.

(21) Appl. No.: 12/803,858

(22) Filed: Jul. 8, 2010

(65) Prior Publication Data

US 2010/0275372 A1 Nov. 4, 2010

Related U.S. Application Data

(63) Continuation of application No. 12/009,704, filed on Jan. 22, 2008, now Pat. No. 7,784,122.

(51) Int. Cl.
*A47C 19/12* (2006.01)

(52) U.S. Cl. ..... 5/201; 5/174; 5/176.1

(58) Field of Classification Search ..... 5/200.1, 5/201, 202, 176.1, 174
See application file for complete search history.

(56) References Cited

U.S. PATENT DOCUMENTS 3,713,181 A 1/1973 Hougland ..... 5/176
3,881,202 A 5/1975 Tyhanic ..... 5/176
5,758,372 A * 6/1998 Lopez Diaz ..... 5/200.1
6,286,161 B1 9/2001 McCall ..... 5/400
7,739,760 B2 * 6/2010 Wang et al. ..... 5/176.1
2007/0151026 A1 7/2007 Felix ..... 5/201

* cited by examiner

*Primary Examiner* — Fredrick Conley

(74) *Attorney, Agent, or Firm* — Imperium Patent Works; Darien K. Wallace

(57) ABSTRACT

A mattress-supporting base includes three mattress support portions, multiple crossbars and a baseboard. Each of the mattress support portions has a first end and a second end. The first end of each mattress support portion connects to the first ends of the other two mattress support portions, and the second end of each mattress support portion connects to the second ends of the other two mattress support portions. The first two mattress support portions have four sections that are pivotally connected by three hinges. The third and center mattress support portion has two sections that are pivotally connected. The components of the mattress-supporting base fit into a packing box having an inner width that is neither wider than about ten times the width of the mattress support portions plus about eight times the thickness of the baseboard, nor longer than about one half the length of the assembled mattress-supporting base.

20 Claims, 8 Drawing Sheets

MATTRESS-SUPPORTING BASE

CROSS REFERENCE TO RELATED APPLICATION

This application is a continuation of, and claims priority under 35 U.S.C. §120 from, nonprovisional U.S. patent application Ser. No. 12/009,704 entitled "A Mattress-Supporting Base," filed on Jan. 22, 2008, now U.S. Pat. No. 7,784,122. application Ser. No. 12/009,704 in turn is a continuation of, and claims priority under 35 U.S.C. §119 from Chinese Patent Application No. 200720007746.0, filed on Jul. 24, 2007, in China. The subject matter of both of these patent documents is incorporated herein by reference.

TECHNICAL FIELD

The present invention relates to a mattress-supporting base assembled from components that are packaged in a compact kit for ease of storage and transportation.

BACKGROUND

Conventional beds generally include a mattress supported upon a box-spring, a wooden bed frame or both. Box-springs are generally designed to have the outward appearance of a mattress, being covered by quilted fabric and cushioning, for example. Generally, box-springs have a wooden rectangular frame supporting an array of springs to provide firm support for the mattress.

Bed frames may simply support a mattress on boards spanning between side rails of the frame, or may accommodate a box-spring. Bed frames conventionally have a headboard, a footboard and two side rails, and are constructed to be easily assembled and disassembled.

A box-spring is typically constructed in one piece and of the same dimensions as the mattress it supports. Legs may be provided with embedded threaded metal rods to be screwed into threaded inserts in the bottom of the box-spring frame, when the box-spring is used without a bed frame.

A conventional box-spring, due to its stiff wooden frame, is often heavy and awkward to handle, especially the larger "king-size" or "queen-size" variety. The dimensions of a conventional box-spring make it impractical for a consumer to transport the box-spring home from a mass-market retail store. For example, the typical box-spring does not fit in the trunk of a car. Moving such a box-spring into apartment elevators and around corners into bedrooms is often difficult and exposes the box-springs and doorways to potential damage. In addition, the dimensions of a conventional box-spring take up valuable floor space which discourages mass-market stores from offering box-springs to their retail customers.

A support for a mattress is sought that provides all of the support, comfort and aesthetic qualities of a conventional box-spring but yet that reduces the storage space requirements and shipping bulk of the support before it is used to support a mattress.

SUMMARY

A mattress-supporting base includes three mattress support portions, multiple top support rails, a baseboard and a covering. Each of the mattress support portions has a first end and a second end. The first end of each mattress support portion connects to the first ends of the other two mattress support portions, and the second end of each mattress support portion connects to the second ends of the other two mattress support portions. The first two mattress support portions have four sections that are pivotally connected by three hinges. The third and center mattress support portion has two sections that are pivotally connected. The components of the mattress-supporting base fit into a packing box having an inner width that is neither wider than about ten times the width of the mattress support portions plus about eight times the thickness of the baseboard, nor longer than about one half the length of the assembled mattress-supporting base.

The first mattress support portion has a first connection location with a first configuration and a second connection location with a second configuration. The second mattress support portion has a third connection location with a third configuration and a fourth connection location with a fourth configuration. The third mattress support portion has a fifth connection location with a fifth configuration and a sixth connection location with a sixth configuration. The first, third and fifth configurations fit together and permit the fifth connection location to be connected to the first connection location and to the third connection location. The second, fourth and sixth configurations fit together and permit the sixth connection location to be connected to the second connection location and to the fourth connection location.

A slot is formed when the first connection location and the third connection location are connected together. The fifth configuration has a tab that fits into the slot when the fifth connection location is connected to the first connection location and to the third connection location.

A packaging method packages the three mattress support portions, the baseboard and multiple top support rails of the mattress-supporting base into a packing box. Each of the mattress support portions has a first end and a second end. The first end of each mattress support portion is adapted to removably engage the first ends of the other two mattress support portions, and the second end of each mattress support portion is adapted to removably engage the second ends of the other two mattress support portions. The packaging method packages the components of the mattress-supporting base into a packing box that has an inner width that is not wider than about ten times the width of the mattress support portions plus about eight times the thickness of the baseboard.

In another embodiment, a mattress-supporting base includes a first side frame including at least two separate but connected sections, and a second side frame connected at a first end to a first end of the first side frame. The second side frame includes two separate but connected sections. The mattress-supporting base also includes a third side frame connected at an end to a second end of the second side frame. The third side frame includes two separate but connected sections. The mattress-supporting base also includes a fourth side frame connected at an end to another end of the third side frame and at another end to a second end of the first side frame. The fourth side frame includes at least two separate but connected sections.

The mattress-supporting base also includes a center frame that itself includes two separate but connected sections. The center frame is connected between the two separate but connected sections of the first and third frames. The mattress-supporting base also includes a plurality of spaced-apart crossbars extending between the second and the fourth side frames.

The mattress-supporting base can be assembled for use from a kit of components. The components are placed together in a compact package for ease of storage and transportation. The components of the mattress-supporting base are designed such that they may be nested together in a compact package of less than approximately one half the size of the package for a conventional base. Therefore storage space requirements and shipping bulk are reduced. The mattress-supporting base provides a foldable bed frame that can be carried by one adult. Thus, one user can carry the mattress-supporting base home and assemble it easily and conveniently.

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
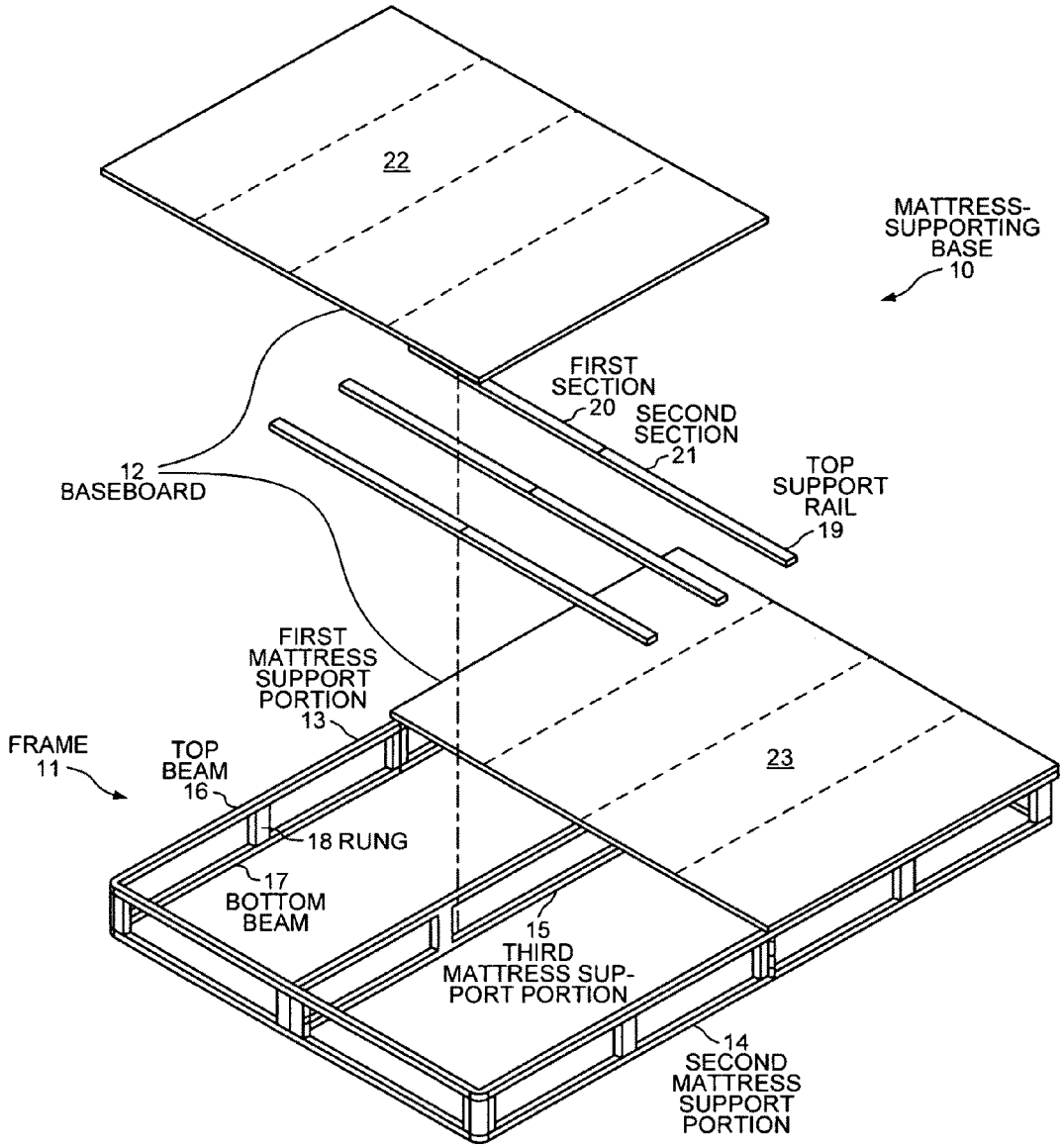
FIG. 1 is a partially exploded perspective view of a mattress-supporting base with mattress support portions, top support rails and a baseboard.

FIG. 1 shows a mattress-supporting base 10 including a frame 11 and a baseboard 12 that forms a surface on top of frame 11. Frame 11 includes a first mattress support portion 13, a second mattress support portion 14 and a third mattress support portion 15. The mattress support portions are formed like ladders with two parallel beams connected by rungs. For example, first mattress support portion 13 has a top beam 16, a bottom beam 17 and a rung 18. In one embodiment, the mattress support portions are made of wood, but in other embodiments they are made of plastic, metal or some other material.

FIG. 1 shows mattress-supporting base 10 in an assembled condition. In the assembled condition, first mattress support portion 13 has a open bracket shape "[", and second mattress support portion 14 has a closed bracket shape "]". In the assembled condition, third mattress support portion 15 lies along the center axis of mattress-supporting base 10 and has a linear shape that is parallel to the long portions of both first mattress support portion 13 and second mattress support portion 14, forming a "[|]" shape. Third mattress support portion 15 forms a center frame of frame 11.

Frame 11 of mattress-supporting base 10 also includes top support rails that act at crossbars. Each top support rail has two sections that are connected together by a hinge. For example, FIG. 1 shows a top support rail 19 with a first section 20 and a second section 21. Baseboard 12 includes two separate sections that fit over frame 11. FIG. 1 shows a first baseboard section 22 in an exploded view above three top support rails. First baseboard section 22 is creased such that it can be folded into four sections for easy packaging. A second baseboard section 23 is shown attached to the top of mattress-supporting base 10. The baseboard sections can be attached to frame 11, for example, by hook and loop strips, such as Velcro®. Mattress-supporting base 10 also includes an exterior fabric layer (not shown in FIG. 1) that fits over its top and sides.

Figure 2:
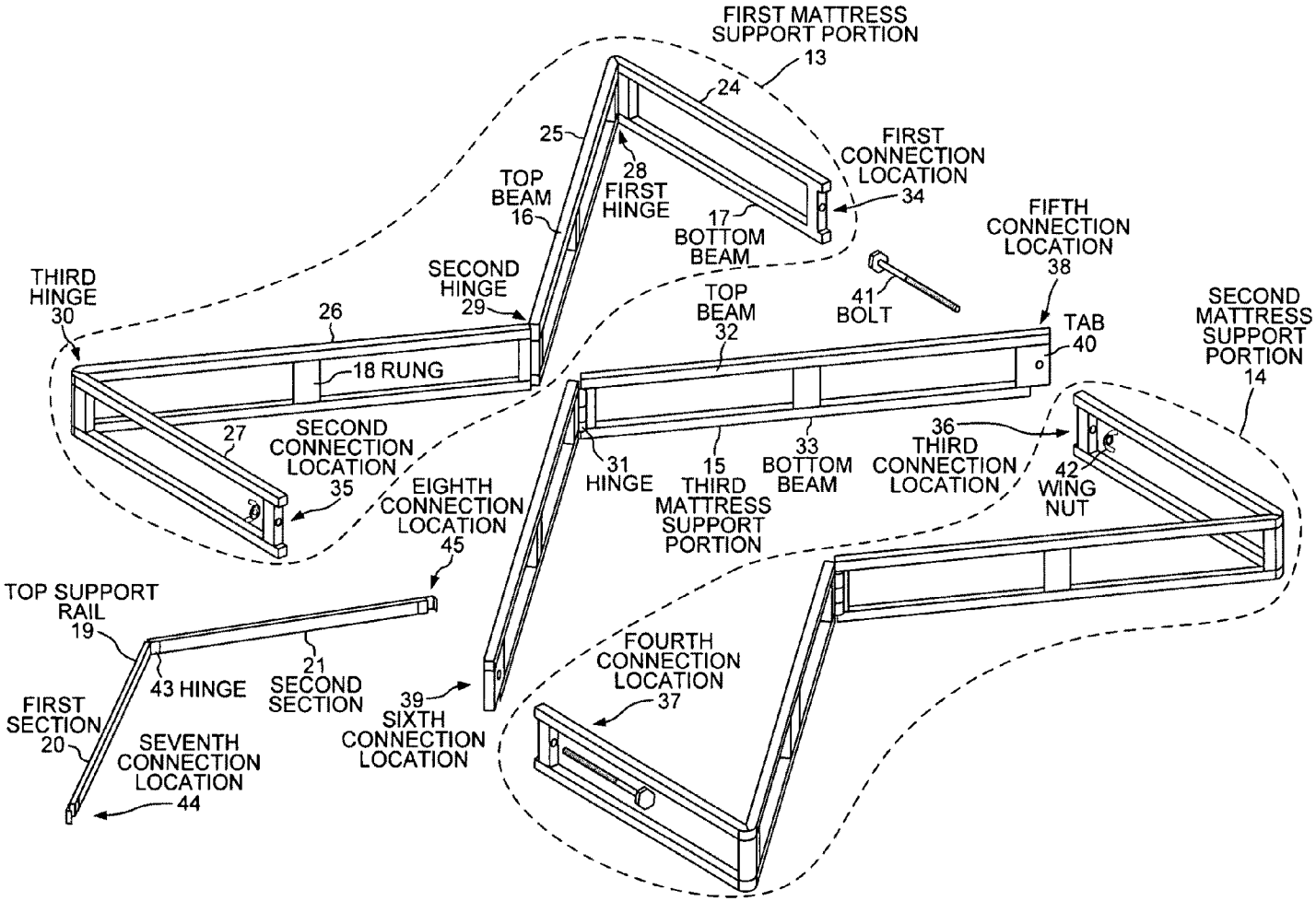
FIG. 2 is a perspective view of three mattress support portions and a top support rail that are part of the mattress-supporting base of FIG. 1.

FIG. 2 shows some of the components of frame 11 in more detail in an unassembled condition. The components of frame 11 are configured such that they can be folded into shapes and sizes that can fit into a packing box that has an inner length that is not longer than approximately one half as long as the length of the assembled mattress-supporting base 10. In addition, the components of mattress-supporting base 10 including first baseboard section 22 and second baseboard section 23 can be folded into shapes and sizes that can fit into a packing box that is less than about one quarter as wide as the width of the assembled mattress-supporting base 10. The components of mattress-supporting base 10 fit into a packing box whose inner width is about ten times the width of the beams of the three mattress support portions plus about eight times the thickness of baseboard 12. The top support rails and the covering for mattress-supporting base 10 are placed in the packing box on top of the mattress support portions.

By assembling the components of mattress-supporting base 10 only after the packing box has been transported to the location of the mattress to be supported, damage to doorways and mattress-supporting base 10 can be avoided. In addition, the packing box containing the components of mattress-supporting base 10 can be more easily maneuvered up stairs, into apartment elevators and around corners than would an assembled box-spring.

First mattress support portion 13 has four sections 24-27 connected by three hinges 28-30. First hinge 28 connects first section 24 to second section 25; second hinge 29 connects second section 25 to third section 26; and third hinge 30 connects third section 26 to fourth section 27. In one embodiment, hinges 28-30 are butt hinges similar to those used on inner doors in typical residential houses. In other embodiments, hinges 28-30 are barrel hinges, non-mortise hinges, swaged hinges, hinges made of reinforced fabric or even hinges made of leather. FIG. 2 shows top beam 16, bottom beam 17 and rung 18 of first mattress support portion 13.

Figure 3:
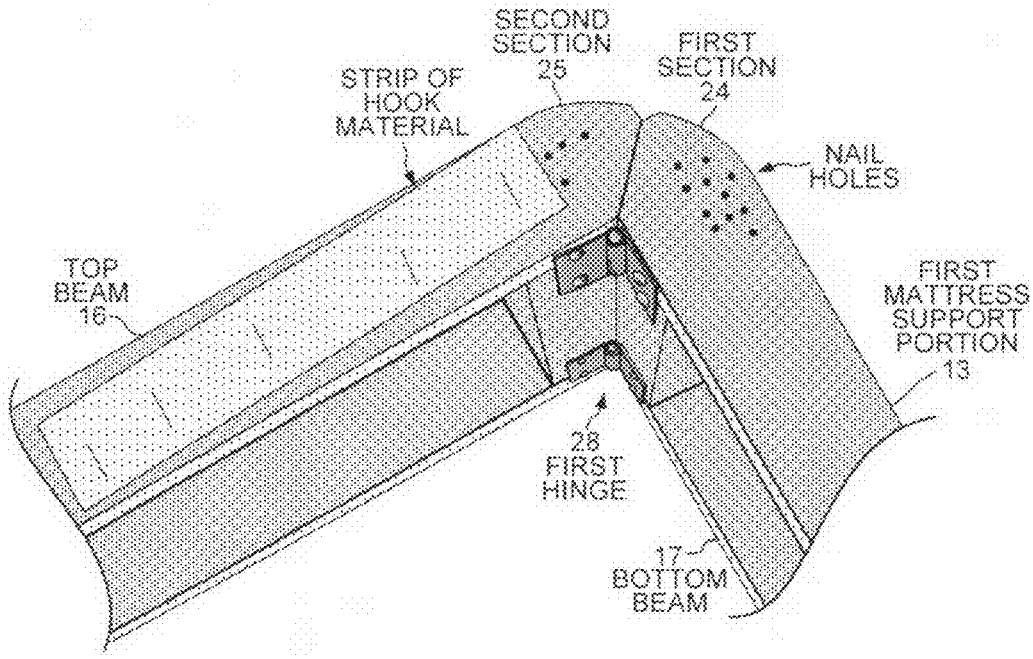
FIG. 3 is a more detailed view of a hinge that connects sections of a first mattress support portion.

FIG. 3 is a more detailed view of first hinge 28 that connects first section 24 to second section 25. FIG. 3 shows that first hinge 28 is made up of a lower hinge and an upper hinge. FIG. 3 also shows the nail holes created by nails used to attach top beam 16 to rungs between top beam 16 and bottom beam 17. A strip of hook material is shown stapled to the top of top beam 16. The strip of hook material attaches to a strip of loop material on a corresponding location on the bottom of baseboard 12 and holds baseboard 12 in place over frame 11.

Second mattress support portion 14 has four sections connected by three hinges in a manner similar to, but in the mirror image of, first mattress support portion 13. Third mattress support portion 15 has two sections pivotally connected by a hinge 31. The two sections of third mattress support portion 15 are approximately of equal length. FIG. 2 also shows a top beam 32 and a bottom beam 33 of third mattress support portion 15.

First mattress support portion 13 has a first connection location 34 and a second connection location 35. First connection location 34 has a first configuration and second connection location 35 has a second configuration. Second mattress support portion 14 has a third connection location 36 with a third configuration and a fourth connection location 37 with a fourth configuration. Third mattress support portion 15 has a fifth connection location 38 with a fifth configuration and a sixth connection location 39 with a sixth configuration. The fifth configuration has tab 40 that is located below top beam 32 and above bottom beam 33. Bottom beam 33 does not extend as far as the end of top beam 32 and tab 40, but rather ends at a distance from the end of tab 40 that equals the width of bottom beam 17 of first mattress support portion 13 and the bottom beam of second mattress support portion 14.

Figure 4:
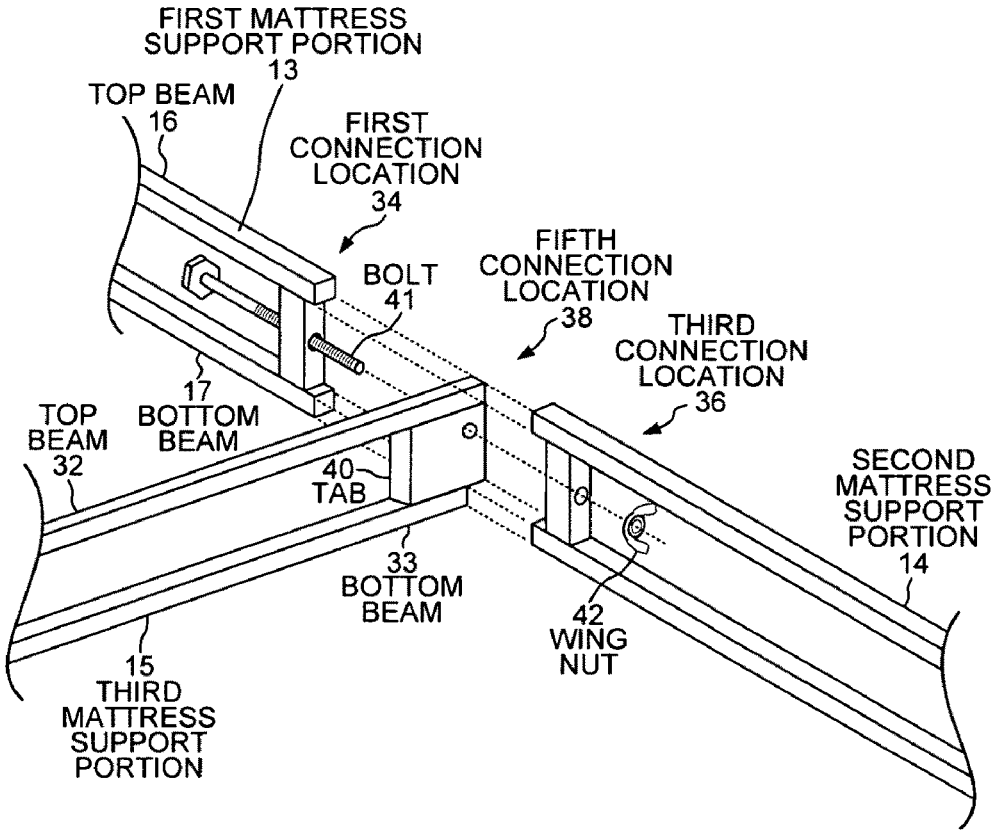
FIG. 4 is a more detailed view of the location where ends of the mattress support portions are connected together in the assembled condition of the mattress-supporting base of FIG. 1.

FIG. 4 shows in more detail how the first, third and fifth configurations fit together. First connection location 34 is a jaw formed by a rung between top beam 16 and bottom beam 17. Third connection location 36 is also a jaw formed by a rung between a top beam and a bottom beam of second mattress support portion 14. Tab 40 is shaped as a tongue that, together with top beam 32, fits into an opening formed when the jaw of first connection location 34 closes with the jaw of third connection location 36. From FIG. 4 it is apparent that third mattress support portion 15 is not as high as either first mattress support portion 13 or second mattress support portion 14. Third mattress support portion 15 is lower than the other two mattress support portions by the thickness of top beam 16 of first mattress support portion 13 and of the top beam of second mattress support portion 14.

Each of the first configuration, the third configuration and the fifth configuration has a hole. The holes of the first configuration and the third configuration run parallel to the top and bottom beams at the first connection location 34 and at the third connection location 36. At the fifth connection location 38, the hole of the fifth configuration is perpendicular to top beam 32 and bottom beam 33. The holes of each of the first configuration, the third configuration and the fifth configuration are adapted to allow a bolt 41 to pass through the holes in the assembled condition of frame 11 when the fifth connection location is connected to the first connection location and to the third connection location. In the assembled condition of frame 11, a wing nut 42 screws onto bolt 41 and tightens the first, fifth and third connection locations together. In a similar fashion, a bolt and wing nut are used to connect sixth connection location 39 to second connection location 35 and fourth connection location 37.

Returning to FIG. 2, first section 20 and second section 21 of top support rail 19 are shown pivotally connected by a hinge 43. Hinge 43 is made from a reinforced piece of fabric or tarp that is stapled to both first section 20 and second section 21. Top support rail 19 has a seventh connection location 44 and an eighth connection location 45. Each of seventh connection location 44 and eighth connection location 45 has the configuration of a bracket.

Figure 5:
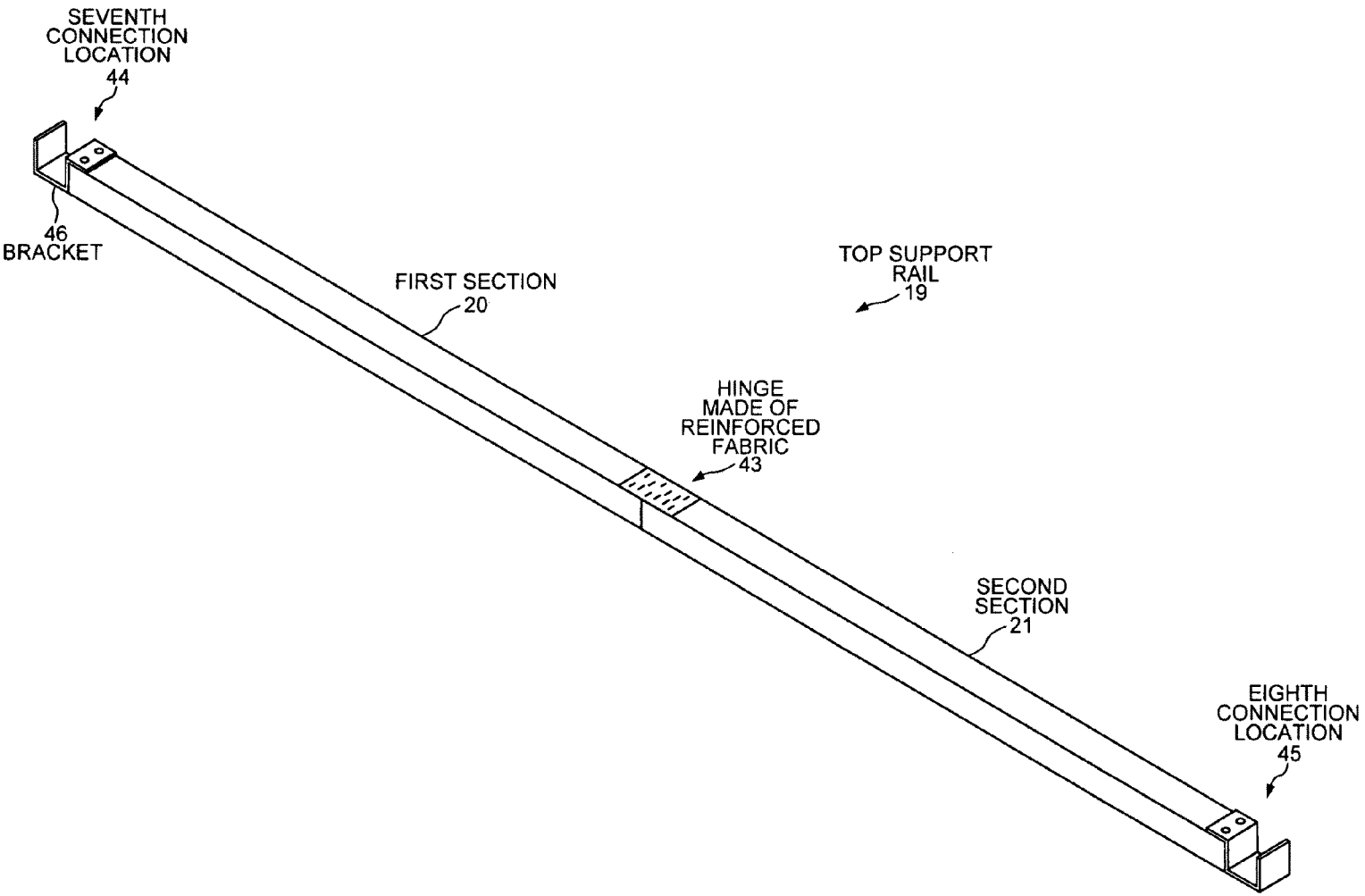
FIG. 5 is a perspective view of one of the top support rails and its brackets.

FIG. 5 shows top support rail 19 in more detail. Seventh connection location 44 includes an inverted U-shaped bracket 46.

Figure 6:
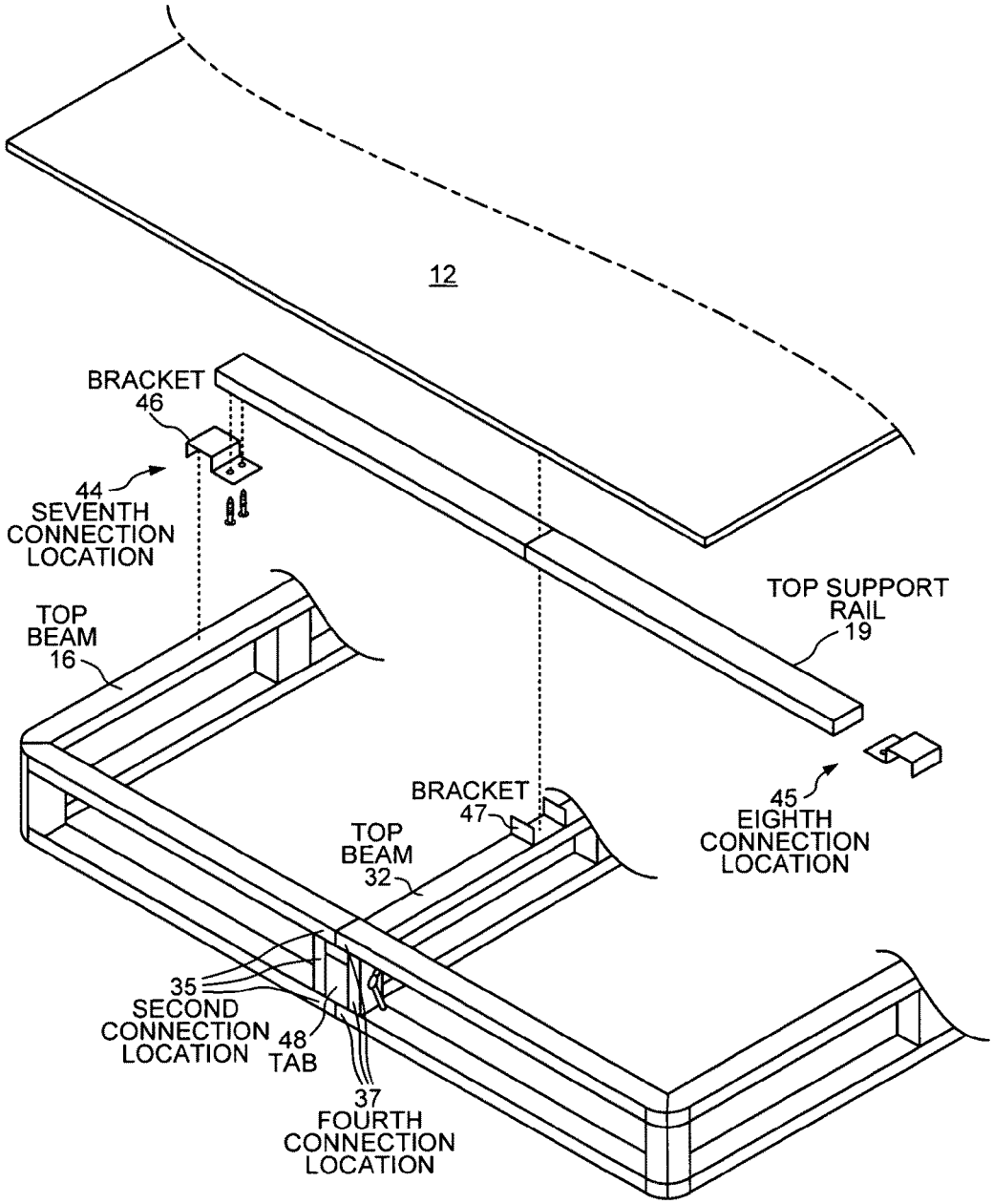
FIG. 6 is a partially exploded perspective view of a portion of the mattress-supporting base of FIG. 1 showing how a top support rail fits onto the three mattress support portions.

FIG. 6 illustrates in more detail how top support rail 19 and the other top support rails fit over the three mattress support portions in the assembled condition of frame 11. Along the top of top beam 32 of third mattress support portion 15 are U-shaped brackets, such as a bracket 47. Hinge 43 of top support rail 19 fits into bracket 47, with the fabric of hinge 43 facing top beam 32. Inverted U-shaped bracket 46 fits down over top beam 16, and the inverted U-shaped bracket at eighth connection location 45 fits down over the top beam of second mattress support portion 14. Because the height of third mattress support portion 15 plus the thickness of the top support rails approximately equals the heights of first mattress support portion 13 and second mattress support portion 14, the top surface of the top support rails is even with the top surface of the top beams of first mattress support portion 13 and second mattress support portion 14. This allows baseboard 12 to lie in a plane across the top of frame 11.

FIG. 6 shows how bracket 46 is attached to top support rail 19 by screws. FIG. 6 also shows a tab 48 on the other side of third mattress support portion 15 from tab 40.

Figure 7:
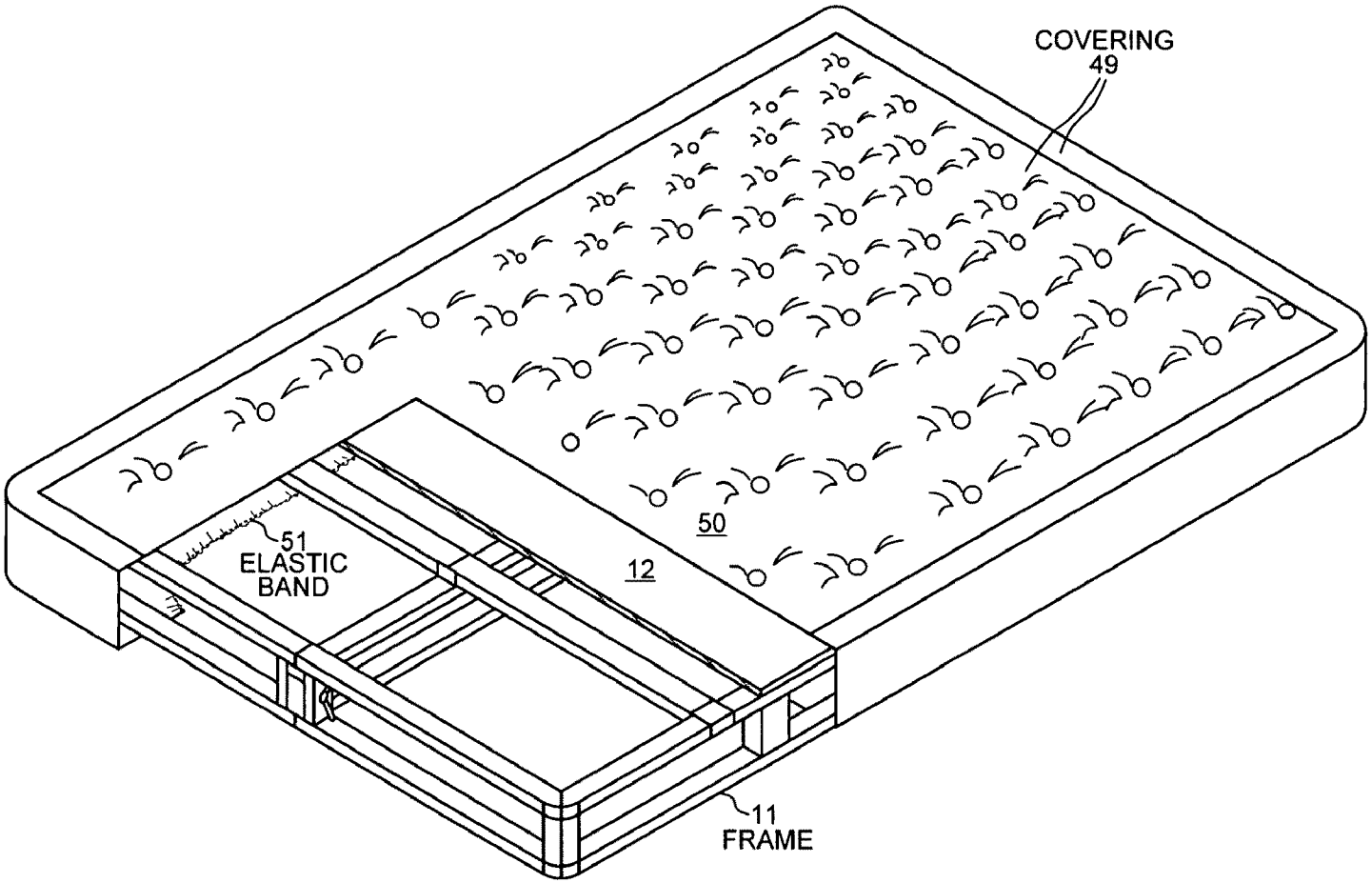
FIG. 7 is a partially broken away perspective view of the mattress-supporting base of FIG. 1 showing a covering over the mattress support portions, the top support rails and the baseboard.

FIG. 7 shows a partially broken-away perspective view of mattress-supporting base 10 in a fully assembled condition. Along with frame 11 and baseboard 12, mattress-supporting base 10 includes a covering 49. Covering 49 has a minimally padded and quilted top section 50. In another embodiment, the quilting covers the sides of mattress-supporting base 10, as opposed to the top. Covering 49 also has an elastic band 51 around the bottom that pulls covering 49 tight around frame 11 and baseboard 12. In another embodiment, covering 49 has a pull-string as opposed to an elastic band.

Figure 8:
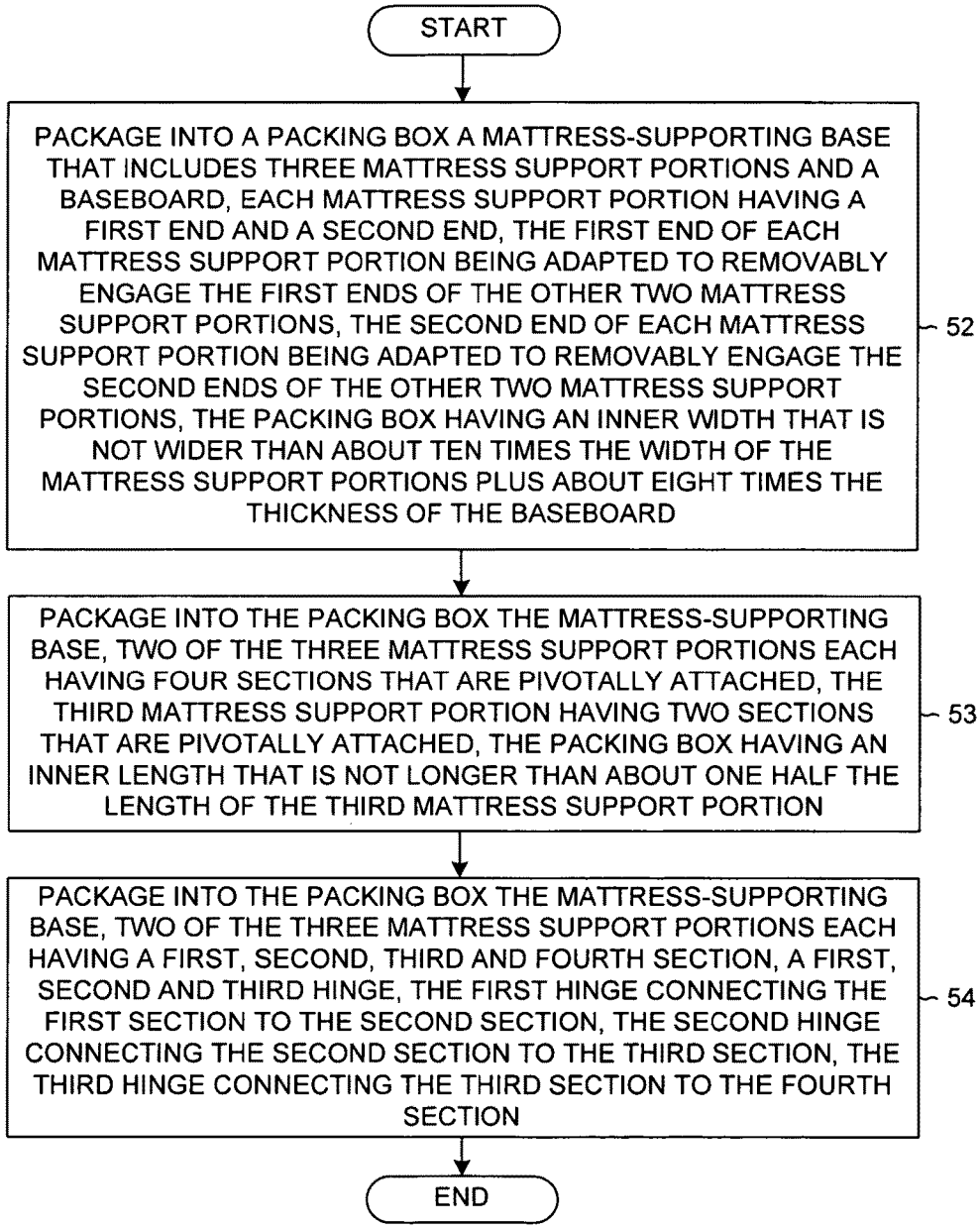
FIG. 8 is a flowchart of steps for packaging the mattress-supporting base into a packing box.

FIG. 8 is a flowchart of steps 52-54 for packaging mattress-supporting base 10 into a packing box for shipment from the manufacturer to a mass-market retail store. Step 52 describes packaging mattress-supporting base 10 into a packing box whose inner width is not wider than about ten times the width of mattress support portions 13-15 plus about eight times the thickness of baseboard 12. Step 53 describes packaging mattress-supporting base 10 into a packing box whose inner length is not longer than about one half the length of third mattress support portion 15. Half the extended length of third mattress support portion 15 is also equal to about half the length of mattress-supporting base 10 in an assembled condition. Step 54 describes packaging into a packing box first mattress support portion 13 and second mattress support portion 14 of mattress-supporting base 10, wherein each of these mattress support portions has four sections connected by three hinges.

In another embodiment, a mattress-supporting base includes four side frames. Each side frame includes a top part, a bottom part and a plurality of vertical rungs. The first side frame includes at least two separate but connected sections. The second side frame is connected at an end to an end of the first side frame. The second side frame includes at least two separate but connected sections. The third side frame is connected at an end to another end of the second side frame. The third side frame includes at least two separate but connected sections. The fourth side frame is connected at an end to another end of the third side frame, and at another end to another end of the first side frame. The fourth side frame includes at least two separate but connected sections.

The mattress-supporting base also includes a center frame with at least two separate but pivotally connected sections. The center frame is connected to between the two separate but connected sections of the second frame and the fourth frame. The center frame has a tongue that extends into two jaws, each jaw being in the separate sections of its respective side frame, and each jaw being formed between the respective side frame top part, the side frame bottom part, and a vertical rung. The center frame is connected to the two separate but connected sections of its respective side frame by passing a bolt through aligned openings in the center frame tongue and the vertical rungs of each jaw.

The two separate but connected sections of the first frame are pivotally connected to each other. In each side frame, the two separate but connected sections are pivotally connected to each other. The first and third side frames are connected on one side at an end to an end of the second and third side frames. The first and third side frames include two separate sections connected to each other on another side of the first and third side frames. All of the connected side frames are pivotally connected to each other.

The mattress-supporting base further includes a plurality of spaced-apart crossbars extending between the first and the third side frames. All of the crossbars comprise two separate but pivotally connected post sections. The post sections are pivotally attached to each other by a flexible fabric attached to each adjoining post section. The center frame has a vertical height that is less than the vertical height of the side frames, so that the vertical height of the center frame and the crossbars is about the same as the vertical height of the side frames. Each of the crossbars is connected to its respective side frame by a bracket having a bottom piece that is attached to the underside of the respective crossbar and a top piece that is attached to the top side of the respective side frame and the bottom piece. The bracket top piece is U-shaped and fits over the top of the side frame. The bottom piece is attached to the crossbar by screws.

The mattress-supporting base also includes a plurality of spaced-apart U-shaped brackets attached to the center frame. Each crossbar is received into one of the U-shaped brackets attached to the center frame. A joint between each crossbar post section is received in the U-shaped bracket. Legs for the mattress-supporting base are provided with embedded, threaded metal rods that screw into threaded inserts in the bottom of box-spring frame of the mattress-supporting base when the base is used without a bed frame.

The mattress-supporting base is prepared for packaging by folding the sides frames. The sections of the first side frame are pivotally connected. One section of the second side frame is pivotally connected to one end of the first side frame, and one section of the fourth side frame is pivotally connected to the other end of the first side frame. The four pivotally connected sections can then be folded one upon the other to reduce the length of the overall assembly. Similarly, the sections of the third side frame are pivotally connected. One section of the second side frame is pivotally connected to one end of the third side frame, and one section of the fourth side frame is pivotally connected to the other end of the third side frame. The four pivotally connected sections can then be folded one upon the other to reduce the length of the overall assembly. The center frame is likewise folded upon itself to reduce its overall length, as are the various crossbars.

Although certain specific exemplary embodiments are described above in order to illustrate the invention, the invention is not limited to the specific embodiments. Although the mattress-supporting base is described above as being constructed of wood, the mattress-supporting base may also be made of metal or plastic. For example, the beams of the mattress support portions can be made of plastic tubing wherein the first and third configurations are adapted to slide into each other and through the fifth configuration. Accordingly, various modifications, adaptations, and combinations of various features of the described embodiments can be practiced without departing from the scope of the invention as set forth in the claims.

What is claimed is:

1. A device comprising:

a first mattress support portion having a first connection location and a second connection location, wherein the first connection location has a first configuration and the second connection location has a second configuration;

a second mattress support portion having a third connection location and a fourth connection location, wherein the third connection location has a third configuration and the fourth connection location has a fourth configuration; and a third mattress support portion having a fifth connection location and a sixth connection location, wherein the fifth connection location has a fifth configuration and the sixth connection location has a sixth configuration, wherein the first configuration, the third configuration and the fifth configuration fit together and permit the fifth connection location to be connected to the first connection location and to the third connection location, and wherein the second configuration, the fourth configuration and the sixth configuration fit together and permit the sixth connection location to be connected to the second connection location and to the fourth connection location.

2. The device of claim 1, wherein the first mattress support portion is made of wood.

3. The device of claim 1, wherein the first configuration is a mirror image of the third configuration.

4. The device of claim 1, further comprising:

a bolt, wherein each of the first configuration, the third configuration and the fifth configuration has a hole, and wherein the holes of each of the first configuration, the third configuration and the fifth configuration are adapted to allow the bolt to pass through the holes when the fifth connection location is connected to the first connection location and to the third connection location.

5. The device of claim 1, wherein the third mattress support portion has a first section, a second section and a hinge, and wherein the hinge connects the first section to the second section.

6. The device of claim 1, wherein the first mattress support portion has a first section, a second section and a hinge, and wherein the hinge connects the first section to the second section.

7. The device of claim 6, wherein first hinge is taken from a group consisting of: a butt hinge, a barrel hinge, non-mortise hinge, a swaged hinge, a hinge made of reinforced fabric, and a hinge made of leather.

8. The device of claim 1, wherein the first mattress support portion has a first section, a second section, a third section and a fourth section, wherein each of the second section and the third section has a first length, wherein the third mattress support portion has a fifth section and a sixth section, and wherein each of the fifth section and the sixth section has the first length.

9. The device of claim 1, wherein the fifth connection location is connected to the first connection location and to the third connection location by a bolt that passes through aligned openings in the first connection location, the fifth connection location and the third connection location.

10. The device of claim 1, wherein the first mattress support portion is ladder-like and includes a top part, a bottom part and a plurality of vertical rungs.

11. A device comprising:

a first mattress support portion having a first connection location and a second connection location, wherein the first connection location has a first configuration and the second connection location has a second configuration;

a second mattress support portion having a third connection location and a fourth connection location, wherein the third connection location has a third configuration and the fourth connection location has a fourth configuration; and a third mattress support portion having a fifth connection location and a sixth connection location, wherein the fifth connection location has a fifth configuration and the sixth connection location has a sixth configuration, wherein the first configuration, the third configuration and the fifth configuration are adapted to removably engage the fifth connection location to the first connection location and the third connection location, and wherein the second configuration, the fourth configuration and the sixth configuration are adapted to removably engage the sixth connection location to the second connection location and the fourth connection location.

12. The device of claim 11, further comprising:

an exterior fabric layer that fits over the first mattress support portion, the second mattress support portion and the third mattress support portion.

13. The device of claim 11, further comprising:

a bolt, wherein each of the first configuration, the third configuration and the fifth configuration has a hole, and wherein the holes of each of the first configuration, the third configuration and the fifth configuration are adapted to allow the bolt to pass through the holes when the fifth connection location is connected to the first connection location and to the third connection location.

14. The device of claim 11, further comprising:

a bolt, wherein each of the first configuration, the third configuration and the fifth configuration has a hole, and wherein the holes of each of the first configuration, the third configuration and the fifth configuration are adapted to allow the bolt to pass through the holes when the fifth connection location is connected to the first connection location and to the third connection location.

15. The device of claim 11, wherein the first mattress support portion has a first section, a second section and a hinge, and wherein the hinge connects the first section to the second section.

16. The device of claim 15, wherein first hinge is taken from a group consisting of: a butt hinge, a barrel hinge, non-mortise hinge, a swaged hinge, a hinge made of reinforced fabric, and a hinge made of leather.

17. The device of claim 11, wherein the fifth connection location is connected to the first connection location and to the third connection location by a bolt that passes through aligned openings in the first connection location, the fifth connection location and the third connection location.

18. The device of claim 11, wherein the first mattress support portion is made of wood.

19. The device of claim 11, wherein the first mattress support portion has a first section, a second section, a third section and a fourth section, wherein each of the second section and the third section has a first length, wherein the third mattress support portion has a fifth section and a sixth section, and wherein each of the fifth section and the sixth section has the first length.

20. A device comprising:

a first mattress support portion having a first connection location and a second connection location, wherein the first connection location has a first configuration and the second connection location has a second configuration;

a second mattress support portion having a third connection location and a fourth connection location, wherein the third connection location has a third configuration and the fourth connection location has a fourth configuration; and a third mattress support portion having a fifth connection location and a sixth connection location, wherein the fifth connection location has a fifth configuration and the sixth connection location has a sixth configuration, wherein the first configuration, the third configuration and the fifth configuration are adapted to removably engage the fifth connection location to the first connection location and the third connection location, and wherein the second configuration, the fourth configuration and the sixth configuration are adapted to removably engage the sixth connection location to the second connection location and the fourth connection location, wherein the first mattress support portion is ladder-like and includes a first top beam, a first bottom beam and a plurality of longer vertical rungs, wherein the first top beam has a thickness, wherein the third mattress support portion is ladder-like and includes a second top beam, a second bottom beam and a plurality of shorter vertical rungs, wherein a first height is measured from the bottom of the first bottom beam to the top of the first top beam, wherein a second height is measured from the bottom of the second bottom beam to the top of the second top beam, and wherein the first height exceeds the second height by the thickness of the first top beam.

* * * * *